US008043049B2

(12) United States Patent
Chen

(10) Patent No.: US 8,043,049 B2
(45) Date of Patent: Oct. 25, 2011

(54) AIR FAN DAMPING STRUCTURE

(75) Inventor: Chi-An Chen, Taoyuan County (TW)

(73) Assignees: Listan Asia Inc., Kg-Taoyuan County (TW); Listan GmbH & Co., Glinde (DE)

( * ) Notice: Subject to any disclaimer, the term of this patent is extended or adjusted under 35 U.S.C. 154(b) by 412 days.

(21) Appl. No.: 12/402,505

(22) Filed: Mar. 12, 2009

(65) Prior Publication Data

US 2010/0232933 A1 Sep. 16, 2010

(51) Int. Cl.
*F03D 11/00* (2006.01)

(52) U.S. Cl. ..... 415/119; 415/213.1; 415/214.1

(58) Field of Classification Search ..... 415/119, 415/213.1, 214.1
See application file for complete search history.

(56) References Cited

U.S. PATENT DOCUMENTS

| | | | | |
|---|---|---|---|---|
| 7,168,920 | B2 * | 1/2007 | Liu | 415/220 |
| 7,488,152 | B2 * | 2/2009 | Liang | 415/119 |
| 7,537,429 | B2 * | 5/2009 | Xia et al. | 415/119 |
| 2007/0242430 | A1 * | 10/2007 | Liu et al. | 361/695 |

FOREIGN PATENT DOCUMENTS

TW M242987 9/2004

* cited by examiner

*Primary Examiner* — Trung Q Dang
(74) *Attorney, Agent, or Firm* — Muncy, Geissler, Olds & Lowe, PLLC

(57) ABSTRACT

An air fan damping structure is installed on an air fan which has a fan frame. The fan frame has an air inlet, an air outlet and a housing space between them to hold a fan blade assembly. The damping structure includes a first buffer and a holding member located on the fan frame. The first buffer is hollow and has a through hole, and a first anchor portion to form an anchor relationship with a second anchor portion formed on the fan frame. The holding member has an inserting portion to run through the through hole and a depressing portion connecting to the inserting portion to receive a force to allow the inserting portion to run through the through hole. The inserting portion and the through hole have respectively a first retaining portion and a second retaining portion to form a retaining relationship.

9 Claims, 5 Drawing Sheets

AIR FAN DAMPING STRUCTURE

FIELD OF THE INVENTION

The present invention relates to an air fan damping structure and particularly to a damping structure to reduce vibration generated by an air fan during operation.

BACKGROUND OF THE INVENTION

These days people increasingly rely on computers to do businesses and daily works. Hence the computer becomes almost an indispensable technology product to the life of many people. The computer generally has many circuit boards and electronic elements. When in use, the chips and integrated circuits on the circuit boards generate heat and result in high temperature. If the temperature rises higher than an upper temperature limit of normal operation temperature of electronic elements, the electronic elements could malfunction. Hence the computer usually has a cooling fan installed inside to lower the temperature of the electronic elements during operation. Advance of technology and increasing demand of consumers accelerate changes of computer information products. System processing speed has to be faster and performance more powerful to meet those requirements. As a result, a greater amount of heat also is generated. In order to lower the temperature quickly to enable the electronic elements to function normally, aside from adding the number of air fans, another general approach is to increase the rotation speed of the air fans.

While increasing the rotation speed of the air fan can enhance cooling effect, vibration of the air fan also increases. As a result, shaking and impact of the air fan against the installed chassis, such as computer casing, power supply panel and the like occurs, and noises are generated. To remedy this problem, a simple conventional method often being adopted is adding a buffer element between the air fan and the chassis to absorb the vibration generated by air fan operation and prevent direct contact between them.

For instance, R.O.C. patent No. M242987 discloses a cooling fan equipped with a shock absorbing pad. The cooling fan has fastening holes each is wedged with a shock absorbing pad. The shock absorbing pad has a bushing coupled with each fastening hole and a flanged disc extended from the periphery of the bushing. The shock absorbing pad further has a through hole in the center axis. During installation, a screw runs through the through hole of the shock absorbing pad to fasten the cooling fan to an anchor dock, and the screw head presses firmly to the flanged disc. Thereby vibration generated from the anchor dock can be buffered by the shock absorbing pad to reduce noises caused by the vibration.

However, the aforesaid technique requires extra tools such as screwdrivers to turn the screws during installation and disassembly of the air fan. More installation time is needed, and installation also is tedious.

SUMMARY OF THE INVENTION

The primary object of the present invention is to solve the aforesaid disadvantages by providing an air fan damping structure with a simplified installation approach to reduce installation time and improve installation efficiency.

To achieve the foregoing object, the present invention provides an air fan damping structure. The air fan has a fan frame which has an air inlet, an air outlet and a housing space between them to hold a fan blade assembly. The fan frame has at least one damping structure which includes a first buffer and a holding member. The first buffer is hollow and has a through hole inside and a first anchor portion to form a positioning relationship with a second anchor portion on the fan frame. The holding member has an inserting portion running through the through hole and a depressing portion connecting to the inserting portion to receive a force to run through the through hole. The inserting portion and the through hole have respectively a first retaining portion and a second retaining portion to form a retaining relationship between them.

By means of the construction set forth above, assembly and installation can be done quicker and easier than the conventional techniques.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
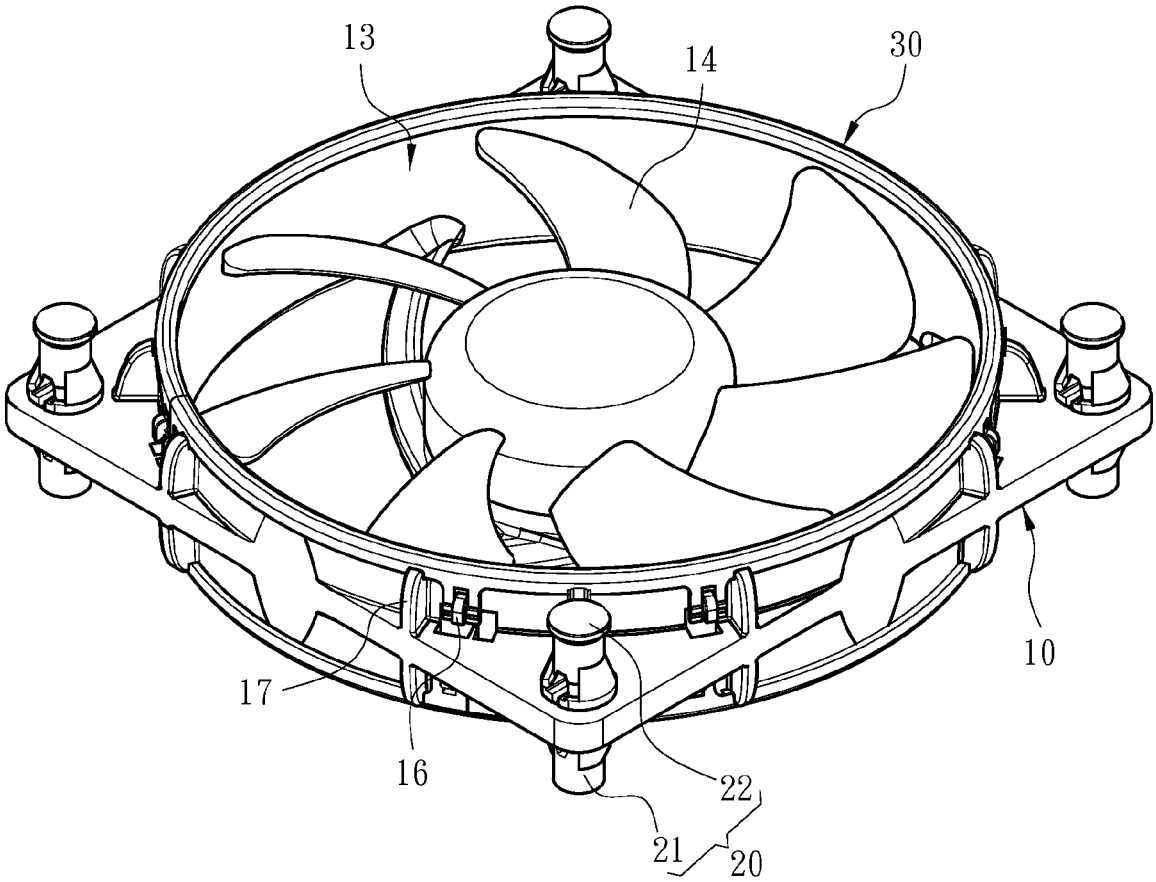
FIG. 1 is a perspective view of the invention.
Figure 2:
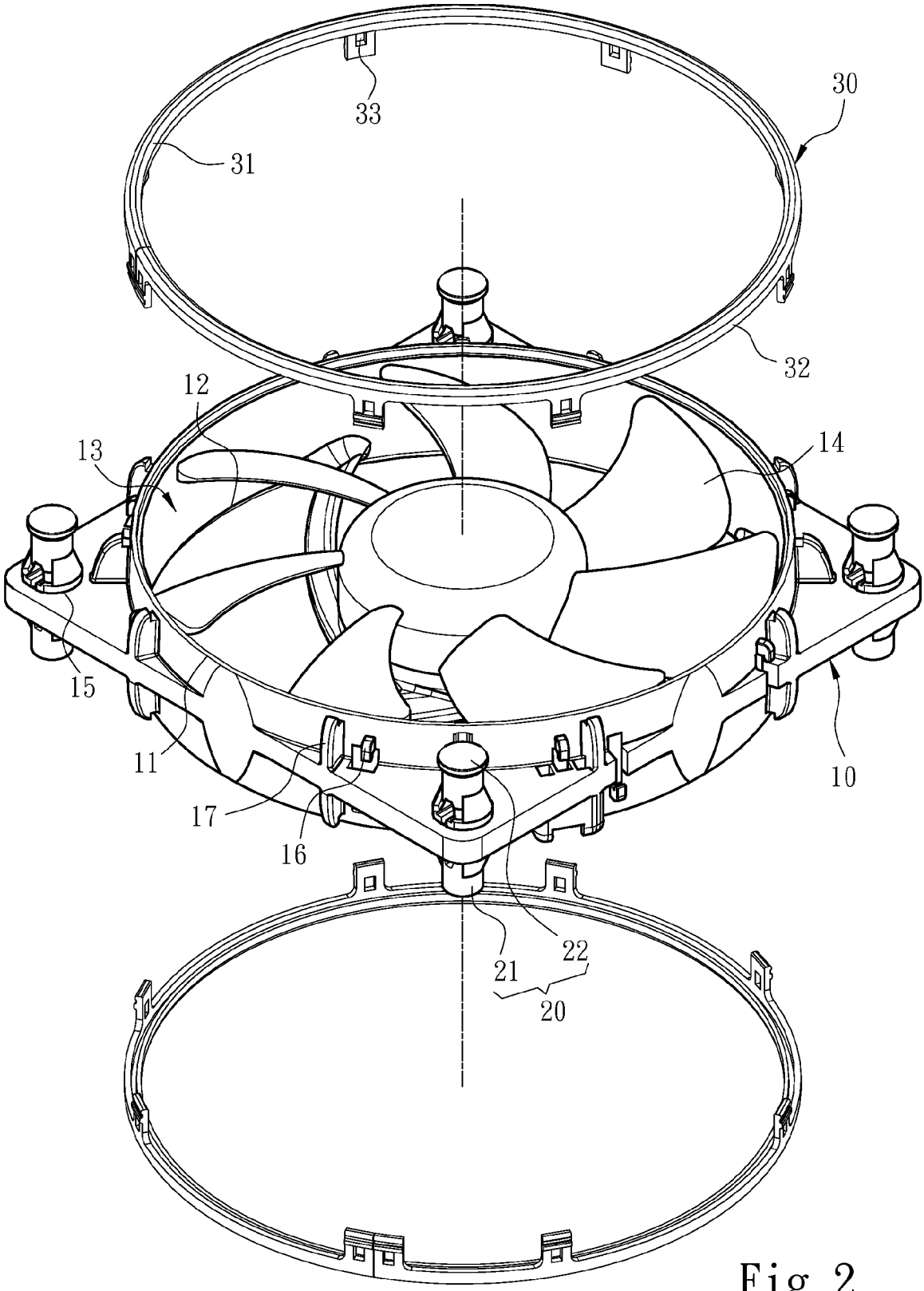
FIG. 2 is an exploded view of the invention.
Figure 3:
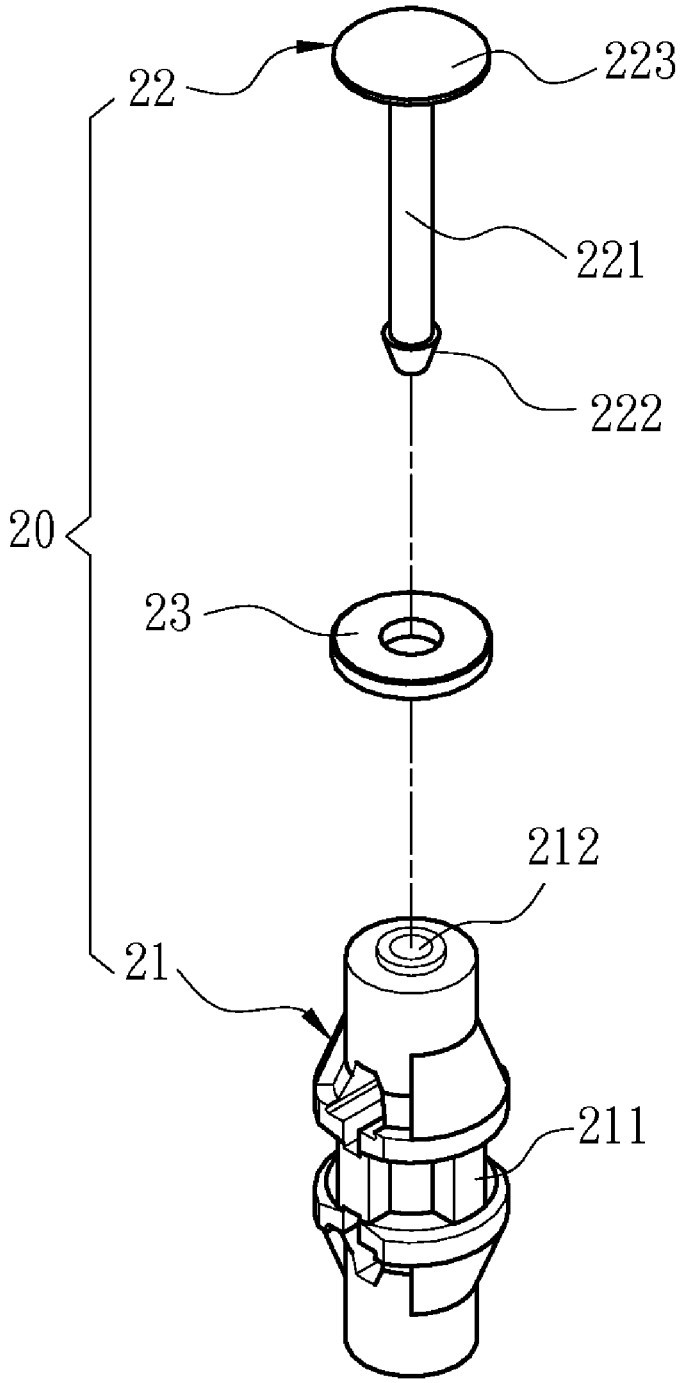
FIG. 3 is another exploded view of the invention.
Figure 4:
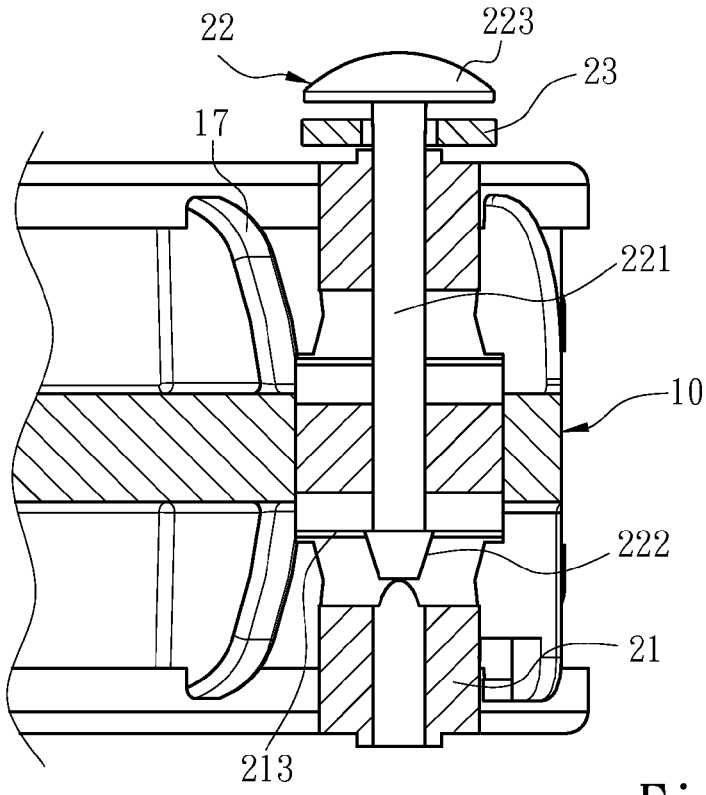
FIG. 4 is a fragmentary sectional view of the invention.

Please refer to FIGS. 1 through 4, the present invention aims to provide an air fan damping structure. The air fan has a fan frame 10 which has an air inlet 11, an air outlet 12 and a housing space 13 between them to hold a fan blade assembly 14. The fan frame 10 also has at least one damping structure 20 located thereon that includes a first buffer 21 and a holding member 22. The first buffer 21 and the fan frame 10 have respectively a first anchor portion 211 and a second anchor portion 15 corresponding to each other. The first and second anchor portions 211 and 15 are respectively a trough and an aperture mating and coupling with each other. The first buffer 21 is a hollow flexible element made from rubber or the like, and has a through hole 212. The holding member 22 has an inserting portion 221 to run through the through hole 212 and a depressing portion 223 connecting to the inserting portion 221 to receive a force to allow the inserting portion 221 to run through the through hole 212. The inserting portion 221 and the through hole 212 have respectively a first retaining portion 222 and a second retaining portion 213 such that after the inserting portion 221 has run through the through hole 212 the first retaining portion 222 and the second retaining portion 213 form an anchor relationship. In an embodiment of the invention, the first and second retaining portions 222 and 213 are respectively a latch member and a latch trough mating each other.

Figure 6:
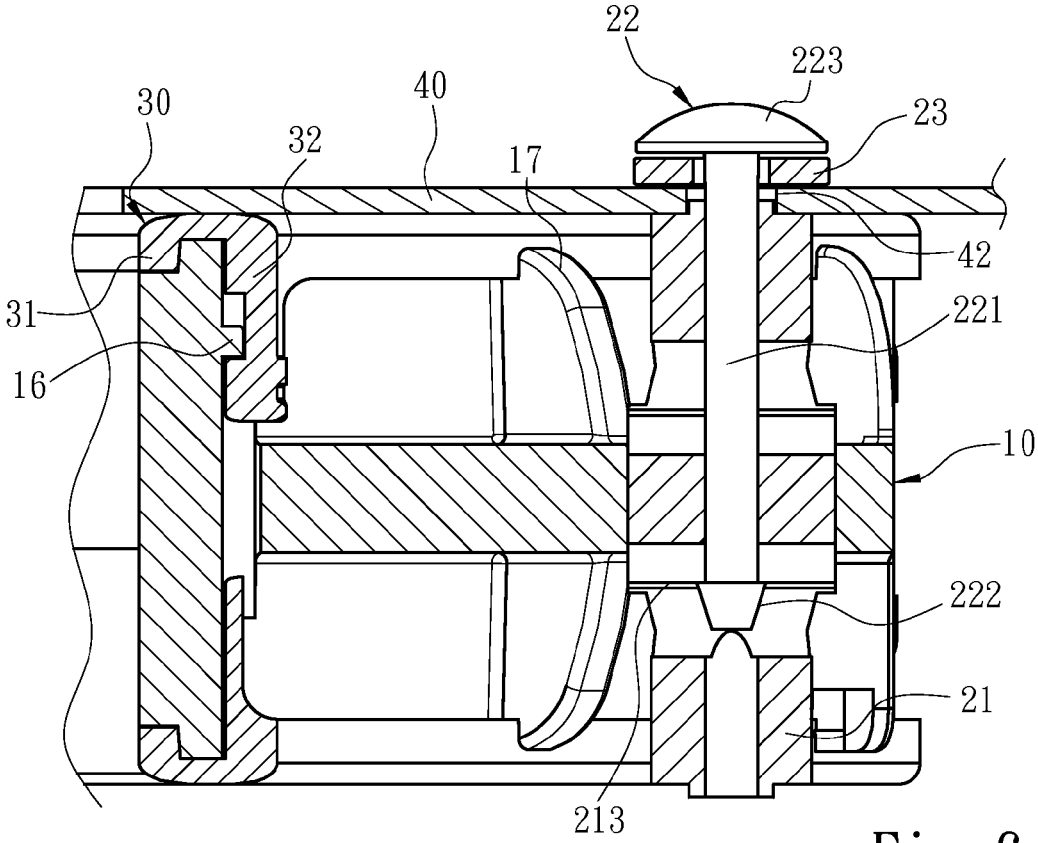
FIG. 6 is a sectional view of an embodiment of the invention.
Figure 5:
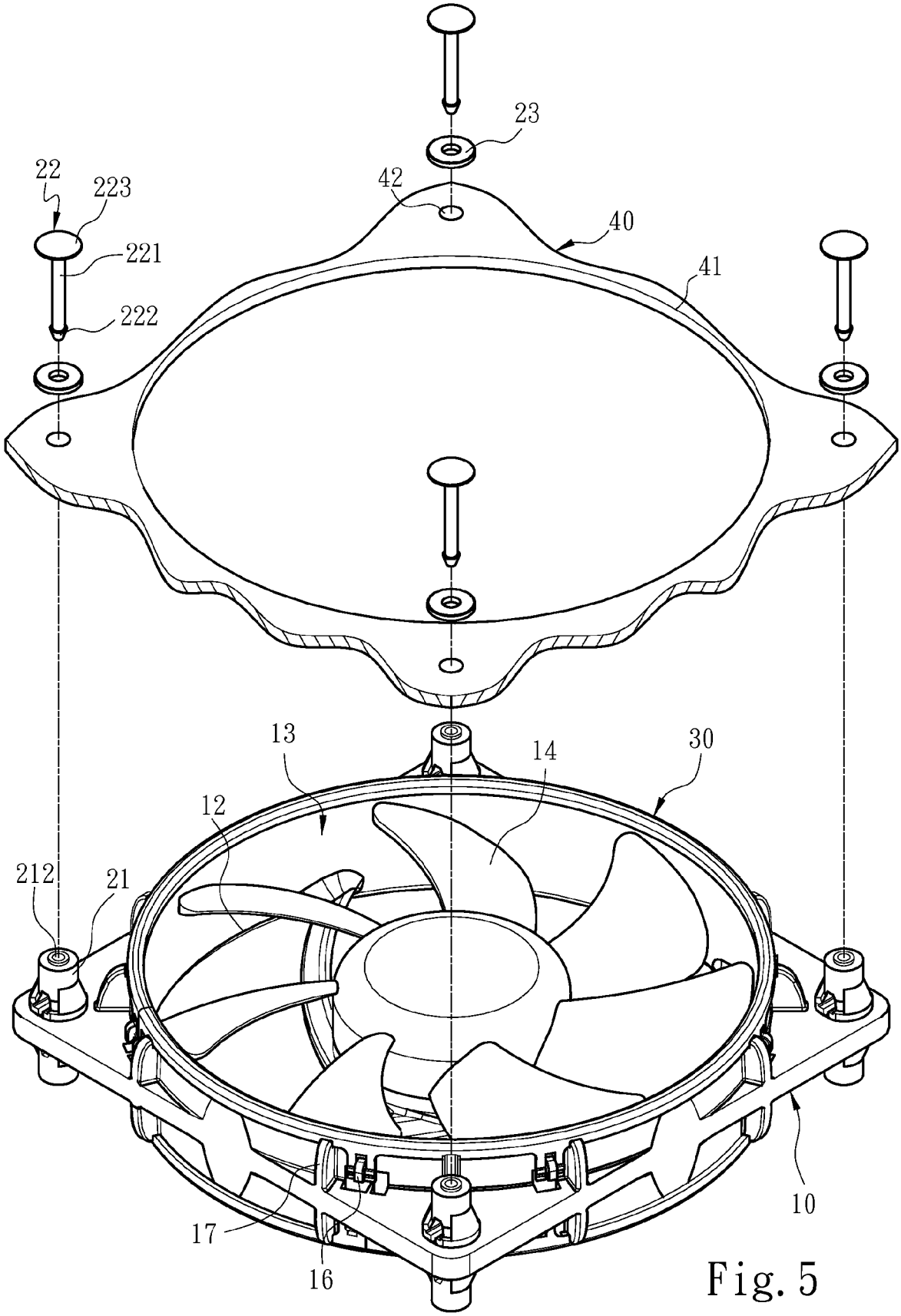
FIG. 5 is an exploded view of an embodiment of the invention.

Moreover, according to the embodiment of the invention, the air inlet 11 and air outlet 12 have respectively a second buffer 30. The air inlet 11 or air outlet 12 has an inner ring 31 at an inner side, and an outer ring 32 at an outer side thereof connecting to the inner ring 31. The fan frame 10 further has at least one supporting portion 17 connecting to and supporting the outer ring 32. The second buffer 30 and the fan frame 10 also have respectively a first coupling portion 33 and a second coupling portion 16 corresponding to and engageable with each other. The first and second coupling portions 33 and 16 are respectively an aperture and a latching hook engageable with each other. Thus the second buffer 30 can be coupled with the air inlet 11 and air outlet 12 of the fan frame 10. In addition, the depressing portion 223 and one edge of the first buffer 21 also are interposed by a washer 23. The washer 23 and the first buffer 21 form a clamping space between them. Referring to FIGS. 5 and 6, the clamping space aims to clamp a targeted coupling member 40 to allow the fan frame 10 and the damping structure 20 to be anchored thereon. The targeted coupling member 40 may be the chassis of a computer, a side panel of a power supply or a casing of any electronic device that needs cooling. The targeted coupling member 40 also has an opening 41 corresponding to the air inlet 11 or air outlet 12 of the fan frame 10, and installation holes 42 corresponding to the second anchor portion 15 of the fan frame 10. For assembly and installation, first, dispose the first buffer 21 on the fan frame 10; insert the holding member 22, in this order, the washer 23, the installation hole 42 of the targeted coupling member 40 and the first buffer 21; through the first retaining portion 222 and second retaining portion 213, a retaining condition is accomplished, then installation is finished. The entire assembly and installation process does not require any tools, hence is simpler and easier. Moreover, the fan frame 10 can be cushioned through the first buffer 21, second buffer 30 and targeted coupling member 40. In addition, the depressing portion 223 and the targeted coupling member 40 also are buffered by the washer 23 between them. As a result, impact between the air fan and the targeted coupling member 40 caused by vibration of air fan operation can be prevented, and noise generation also can be avoided.

As a conclusion, the present invention, through the first buffer 21 and holding member 22, provides damping effect. The first buffer 21 is hollow and has a through hole 212, and has a first anchor portion 211 to form an anchor relationship with a second anchor portion 15 of the fan frame 10. The holding member 22 further has an inserting portion 221 to run through the through hole 212 and a depressing portion 223 connecting to the inserting portion 221. The inserting portion 221 and through hole 212 also have respectively a first retaining portion 222 and a second retaining portion 213 to form a retaining relationship. Therefore, by applying a force on the depressing portion 223, the inserting portion 221 can be inserted into the through hole 212 of the first buffer 21 to finish installation. Operation is simple and can be done quickly. It offers a significant improvement over the conventional techniques.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. An air fan damping structure located on a fan frame of an air fan that has an air inlet, an air outlet and a housing space between the air inlet and the air outlet to hold a fan blade assembly, the damping structure comprising:

a first buffer which is hollow and has a through hole and a first anchor portion to form an anchor relationship with a second anchor portion formed on the fan frame; and a holding member which has an inserting portion to run through the through hole and a depressing portion connecting to the inserting portion to receive a force to allow the inserting portion to run through the through hole, the inserting portion and the through hole having respectively a first retaining portion and a second retaining portion to form a retaining relationship.

2. The air fan damping structure of claim 1, wherein the first anchor portion and the second anchor portion are respectively a trough and an aperture mating each other.

3. The air fan damping structure of claim 1, wherein the first retaining portion and the second retaining portion are respectively a latch element and a latch trough.

4. The air fan damping structure of claim 1, wherein the depressing portion and the first buffer are interposed by a washer, the washer and the first buffer forming a clamping space therebetween.

5. The air fan damping structure of claim 1, wherein fan frame has a second buffer located on the air inlet or the air outlet.

6. The air fan damping structure of claim 5, wherein the second buffer has an inner ring located on an inner side of the air inlet or the air outlet, and an outer ring located on an outer side of the air inlet or the air outlet to connect the inner ring.

7. The air fan damping structure of claim 6, wherein the fan frame has at least one supporting portion connecting to and supporting the outer ring.

8. The air fan damping structure of claim 5, wherein the second buffer and the fan frame have respectively a first coupling portion and a second coupling portion engageable with each other.

9. The air fan damping structure of claim 8, wherein the first coupling portion and the second coupling portion are respectively an aperture and a latch hook engageable with each other.

* * * * *